US005981120A

United States Patent [19]

Gundlach

[11] Patent Number: 5,981,120

[45] Date of Patent: Nov. 9, 1999

[54] VERDEFILM FOR MORE UNIFORM CHARGING

[75] Inventor: Robert W. Gundlach, Victor, N.Y.

[73] Assignee: Xerox Corporation, Stamford, Conn.

[21] Appl. No.: 09/004,474

[22] Filed: Jan. 8, 1998

[51] Int. Cl.[6] ..... G03G 5/14

[52] U.S. Cl. ..... 430/41; 430/60

[58] Field of Search ..... 430/41, 60

[56] References Cited

U.S. PATENT DOCUMENTS

| | | | |
|---|---|---|---|
| 3,909,262 | 9/1975 | Goffe et al. | 96/1.5 |
| 3,975,195 | 8/1976 | Goffe | 96/1 PS |
| 4,013,462 | 3/1977 | Goffe et al. | 96/1 PS |
| 4,281,050 | 7/1981 | Buckley et al. | 430/41 |
| 4,306,008 | 12/1981 | Pai | 430/59 |
| 4,535,457 | 8/1985 | Schlie et al. | 372/58 |
| 4,536,458 | 8/1985 | Ng | 430/41 |
| 4,853,307 | 8/1989 | Tam et al. | 430/41 |
| 5,411,825 | 5/1995 | Tam | 430/41 |

*Primary Examiner*—Christopher D. Rodee
*Attorney, Agent, or Firm*—William A. Henry, II

[57] ABSTRACT

A migration imaging member includes a support substrate, a relatively thick dielectric spacer layer situated on the support substrate, and a softenable layer situated on the dielectric spacer layer, with the softenable layer including a softenable material, and a migration marking material situated at or near the surface of the softenable layer farthest spaced from the support substrate.

5 Claims, 1 Drawing Sheet

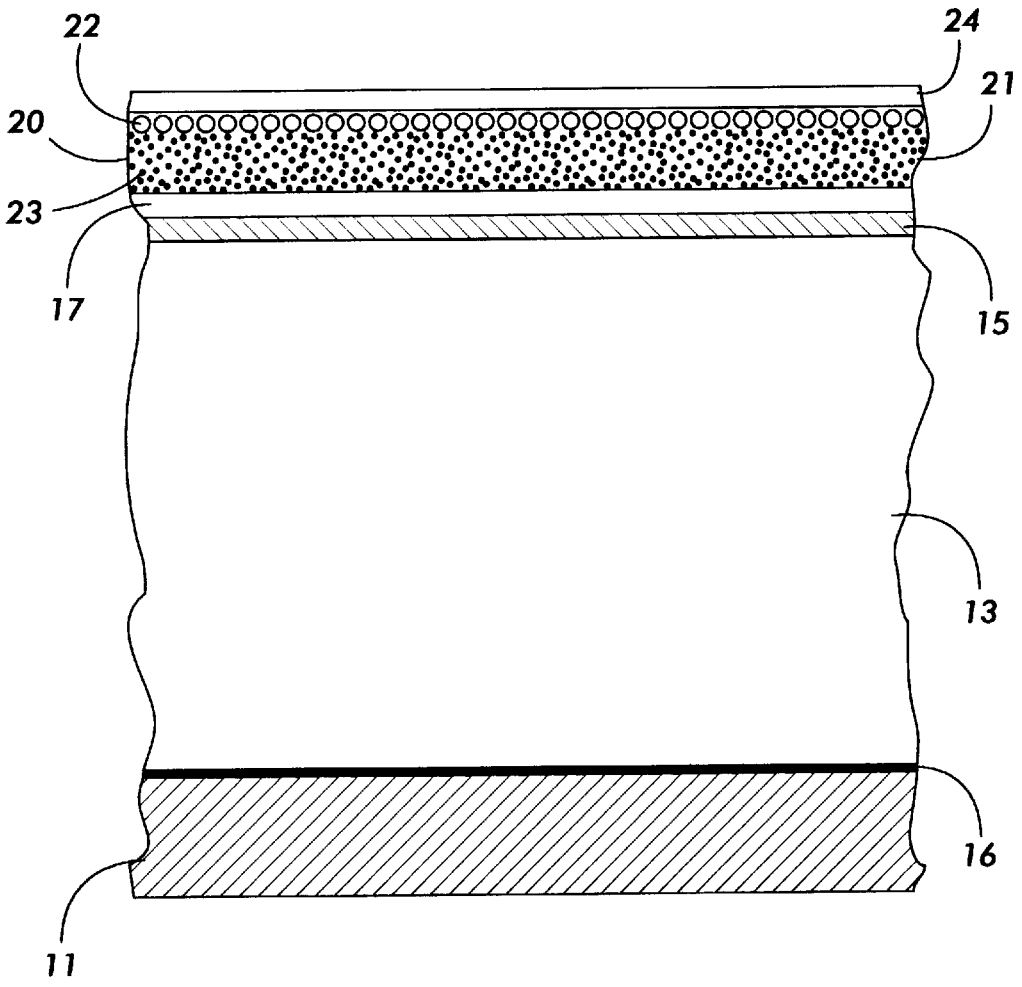
22
24
21
20
23
17
15
13
16
11

VERDEFILM FOR MORE UNIFORM CHARGING

BACKGROUND OF THE INVENTION

1. Field of the Invention

The present invention is directed to a structure for a migration imaging member for which uniform charging is more reliably achieved.

2. Description of Related Art

Heat developable migration imaging members are typically very thin, which allows charging to high charge density and high field strength with relatively low surface potentials. This creates problems for uniform charging because the ratio of surface potential to the electrostatic fields associated with the surface charges is too low.

Migration imaging members are well known, and are described in detail in, for example, U.S. Pat, No. 3,975,195 (Goffe), U.S. Pat. No. 3,909,262 (Goffe) et al., U.S. Pat. No. 4,536,457 (Tam), U.S. Pat. No. 4,536,458 (Ng), U.S. Pat. No. 4,013,462 (Goffe et al.), and "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, Journal of Imaging Science 30 (4) July/August, pp. 183–191 (1986), the disclosures of each of which are totally incorporated herein by reference. Migration imaging members containing charge transport materials in the softenable layer are known, and disclosed, for example in U.S. Pat. No. 4,535,457 (Tam) and U.S. Pat. No. 4,536,458 (Ng), the disclosures of each of which are totally incorporated herein by reference. A typical migration member comprises a substrate, a layer of softenable material, and photosensitive marking material in the form of a fracturable layer contiguous with the upper surface of the softenable layer. The member is imaged by first electrically charging the member and exposing the charged member to a pattern of activation electromagnetic radiation, such as light, to form a latent image on the member. Subsequently, the imaged member is developed by one of several methods, such as application of heat, solvent, solvent vapor, or the like, causing the marking material in the exposed areas of the member to migrate in depth through the softenable material toward the substrate.

The expression "softenable" as used herein is intended to mean any material which can be rendered more permeable, thereby enabling the particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

Typically, conventional scorotrons, for example, 4,591,713, are used to charge a photoreceptor to about 1000 V+/−3% or about 30 V. VerdeFilm (such as disclosed in U.S. Pat. No. 5,411,825 (Tam) and totally included herein by reference), in contrast, has to be charged to an even higher charge density, and with the same percentage of uniformity. A problem lies in the fact that the conventional VerdeFilm is only about 1 micron thick, and must be charged to a surface potential of only about 100 V. The 30 volt variation that is typical of scorotron charging represents only 3% for a photoreceptor that holds a surface potential of 1000 volts, but for a very thin photoreceptor that can support only 100 volts, the 30 volt variation now becomes 30%, which is not acceptable. Even the absolute value of the variation tends to increase for lower voltage charging requirements. For example, when charging to 1000 V the scorotron screen potential is dominant, but when the screen voltage is reduced by an order of magnitude, the relative coronode and the space charge contributions to the asymptote surface potential grow by an order of magnitude.

SUMMARY OF THE INVENTION

Accordingly, a migration imaging member is disclosed that includes a support substrate; a relatively thick dielectric layer situated on the support substrate; an optional adhesive layer situated on the dielectric layer; a charge blocking layer situated on the optional adhesive layer; a charge transport layer situated on the charge blocking layer; and a softenable layer situated on the optional charge transport layer with the softenable layer comprising a softenable material, migration marking material situated at or near the surface of the layer spaced from the substrate, and a charge transport material dispersed throughout the softenable material.

BRIEF DESCRIPTION OF THE DRAWINGS

In the drawings:

The FIGURE is an enlarged, simplified, elevational view showing a migration imaging member in accordance with the present invention.

DESCRIPTION OF THE PREFERRED EMBODIMENT

A migration imaging member 10 in accordance with the present invention is illustrated schematically in the FIGURE and comprises a support substrate 11, a spacer layer 13 to reduce capacitance and thereby increase surface voltage, a charge blocking layer 15 (for possible injected charge), an optional adhesive layer 16 positioned between spacer layer 13 and charge blocking layer 15, if desired, an optional charge transport layer 17 situated on charge blocking layer 15, and a softenable layer 20 situated on optional charge transport layer 17. The softenable layer or migration layer 20 comprises softenable material 21, migration marking material 22 situated at or near the surface of the layer, and optionally, charge transport material 23 dispersed throughout softenable material 21. Optional overcoating layer 24 is situated on the surface of softenable layer 20 spaced from the support substrate 11. Any or all of the optional layers or materials can be absent from the migration imaging member. In addition, any of the optional layers present can be in any suitable configuration, such as, a web, a foil, a laminate, a strip, a sheet, a coil, a cylinder, a drum, an endless belt, an endless mobius strip, a circular disc, or any other suitable form.

By incorporating a relatively thick dielectric layer 13 (i.e., multiple times the thickness of other materials and layers of the imaging member, and preferably, about four times the thickness of other materials and layers of the imaging member) between the free surface of the supporting substrate 11 and blocking layer 15, the capacitance of the chargeable surface of the migration layer to the surface on which the counter charge is induced is substantially reduced, which proportionally increases the surface potential of the migration layer for a given charge density in accordance with the formulas:

$$C = \frac{\epsilon_0 KA}{t},$$

and capacitance per unit area, $$c = \frac{\epsilon_0 K}{t},$$

where: C is the capacitance $\in_0$ is the permittivity of space

K is a dielectric constant

Therefore, $C\alpha 1/t$ so increasing t reduces C, and raises V.

Q=CV (charge Q=Capacitance×Voltage) Unit area charge, $\sigma$=cV

Support substrate 11 is conductive and can be opaque, translucent, semi-transparent, or transparent, and can be of any suitable conductive material, including copper, brass, nickel, zinc, chromium, stainless steel, conductive plastics and rubbers, aluminum, semi-transparent aluminum, steel, cadmium, silver, gold, etc. In addition, the substrate can comprise an insulative layer with a conductive coating, such as vacuum-deposited metallized plastic, etc., wherein the metallized surface is in contact with the migration layer 20 or any other layer situated between the substrate and the migration layer.

The migration layer can comprise one or more layers of softenabale materials, which can be any suitable material, typically plastic or thermoplastic material. By softenable is meant any material that can be rendered by a conventional development step as permeable to migration material migrating through its bulk, as shown for example, in U.S. Pat. No. 3,975,195 which is incorporated herein by reference. The softenable layer can be of any effective thickness, generally from about 1 to about 3.0 microns, and preferably from about 2 to about 2.5 microns. The softenable layer can be applied to the conductive layer by any suitable coating process. Typical coating processes include draw bar coating, spray coating, extrusion, dip coating, gravure roll coating, wire-wound rod coating, air knife coating, and the like.

The migration imaging member 20 also contains migration marking material. The migration marking material can be electrically photosensitive, photoconductive, or of any other suitable combination of materials, or possess any other desired physical property and still be suitable for use in the migration imaging member of the present invention. The migration marking materials preferably are particulate and closely spaced from each other. The migration marking material is generally spherical in shape and submicron in size and is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the substrate. When present as particles, the particles of migration marking material preferably have an average diameter of up to about 2 microns, and more preferably, of about 0.1 to about 1 micron. The layer of migration marking particles is situated at or near that surface of the softenable layer spaced from or most distant from the conductive layer. Preferably, the particles are situated at a distance of from about 0.01 to about 0.1 micron from the layer surface, and more preferably from about 0.02 to about 0.08 micron from the layer surface. Preferably, 0.005 to about 0.2 micron from each other, and more preferably, at a distance of from about 0.05 to about 0.1 micron from each other, the distance being measured between the closest edges of the particles.

Examples of suitable migration marking materials include selenium, alloys of selenium with alloying components, such as, tellurium, arsenic, mixtures thereof, and the like, phthalocyanines, and any other suitable material as disclosed in U.S. Pat. No. 3,975,195 and other U.S. Patents directed to migration imaging members and incorporated herein by reference.

The migration imaging member optionally contains a charge transport material in the softenable layer. The charge transport material can be any suitable material either capable of acting as a softenable layer material or capable of being dissolved or dispersed on a molecular scale in the softenable layer material. When a charge transport material is also contained in another layer in the imaging member, preferably, there is continuous transport of charge throughout the entire film structure. Charge transport materials are well known in the art and typically include Diamine transport molecules of the type described in U.S. Pat. No. 4,306,008 and included herein by reference.

The optional adhesive layer can include any suitable adhesive material, for example, copolymers of styrene and an acrylate, polyester resin, such as, DuPont 49000 (available from E.I. DuPont de Nemours & Company), copolymer of acrylonitrile and vinylidene chloride, polyvinyl acetate, polyvinyl butyral and the like and mixtures thereof. The adhesive layer can have a thickness of about 0.5 micron or less. It can also optionally include charge transport molecules.

The charge transport layer can comprise any suitable film forming binder material. Typical film forming binder materials include, but are not limited to, styrene acrylate copolymers, polycarbonates, co-polycarbonates, polyesters, etc.

The charge blocking layer can be made of aluminum oxide, polyvinyl butyral, silane and he like, as well as, mixtures thereof. The layer is applied by known techniques and is of a thickness of from about 0.05 to about 0.5 micron, and preferably, from about 0.05 to about 0.1 micron.

The optional overcoating layer can be substantially electrically insulating, or have any other suitable properties. The overcoating preferably is substantially transparent and is continuous with a thickness up to about 1 to 2 microns. Typical overcoating materials include acrylic-styrene copolymers, methacrylate polymers, methacrylate copolymers, styrene-bytylmethacrylate copolymers, and the like. The overcoating layer generally protects the softenable layer to provide greater resistance to the adverse effects of abrasion during handling.

According to a preferred embodiment of the present invention, the non-uniformity charging problem with conventional VerdeFilm is reduced by adding a relatively thick dielectric layer between the ground plane and the migration layer to increase the surface potential at the required surface charge density, thereby reducing the percent nonuniformity achieved when charging the film with conventional scorotrons. Alternatively, the spacer layer can be incorporated as the substrate layer by placing the conducting layer on the bottom of the substrate. It would also be possible to eliminate the conducting layer if the migration imaging member were to be charged simultaneously at the top and bottom surfaces to opposite polarities.

While the invention has been described with reference to the structure disclosed, it is not confined to the details set forth, but is intended to cover such modifications or changes as may come within the scope of the following claims.

I claim:

1. A migration imaging member, comprising:

a support substrate;

an adhesive layer situated on said supporting substrate;

a dielectric spacer layer situated on said adhesive layer;

a charge blocking layer positioned on said dielectric spacer layer; and a softenable layer situated on said charge blocking layer, said softenable layer comprising a softenable material, a migration marking material situated at or near the surface of said softenable layer farthest spaced from said support substrate.

2. The migration imaging member of claim 1, including a charge transport layer situated on said charge blocking layer.

3. The migration imaging member of claim 2, including a charge transport material dispersed throughout said softenable material.

4. A migration imaging member, comprising:

a conductive support substrate;

an adhesive layer positioned on said conductive support substrate;

a dielectric spacer layer positioned on said adhesive layer;

a charge blocking layer positioned on said dielectric spacer layer;

a charge transport layer positioned on said charge blocking layer; and a softenable layer having an upper and lower surface and situated on said charge transport layer, said softenable layer comprising a softenable material, migration marking material situated at or near said upper surface of said softenable layer, and a charge transport material dispersed throughout said softenable material.

5. A migration imaging member, comprising:

a conductive support substrate;

an adhesive layer positioned on said conductive support substrate;

a dielectric spacer layer positioned on said adhesive layer:

a charge blocking layer positioned on said dielectric spacer layer;

a charge transport layer positioned on said charge blocking layer;

a softenable layer having an upper and lower surface and situated on said charge transport layer, said softenable layer comprising a softenable material, migration marking material situated at or near said upper surface of said softenable layer, and a charge transport material dispersed throughout said softenable material; and wherein said dielectric spacer layer is about four times as thick as said softenable layer.

* * * * *